US010052517B2

(12) United States Patent
Critelli

(10) Patent No.: US 10,052,517 B2
(45) Date of Patent: Aug. 21, 2018

(54) ADJUSTABLE PROGRESSIVE EXERCISE PLATFORM APPARATUS FOR USE IN A VARIETY OF SETTINGS

(71) Applicant: Andrew Critelli, Bolton (CA)

(72) Inventor: Andrew Critelli, Bolton (CA)

( * ) Notice: Subject to any disclaimer, the term of this patent is extended or adjusted under 35 U.S.C. 154(b) by 0 days.

(21) Appl. No.: 14/795,757

(22) Filed: Jul. 9, 2015

(65) Prior Publication Data

US 2016/0008656 A1 Jan. 14, 2016

Related U.S. Application Data

(60) Provisional application No. 62/022,283, filed on Jul. 9, 2014.

(51) Int. Cl.

| | |
|---|---|
| ***A63B 21/068*** | (2006.01) |
| ***A63B 22/00*** | (2006.01) |
| ***A63B 21/00*** | (2006.01) |
| ***A63B 23/02*** | (2006.01) |
| ***A63B 23/12*** | (2006.01) |

(52) U.S. Cl.

CPC .... *A63B 22/0046* (2013.01); *A63B 21/00047* (2013.01); *A63B 21/00069* (2013.01); *A63B 21/068* (2013.01); *A63B 23/0205* (2013.01); *A63B 23/1227* (2013.01); *A63B 23/1236* (2013.01); *A63B 2210/50* (2013.01)

(58) Field of Classification Search

CPC .. A63B 1/00; A63B 3/00; A63B 17/00; A63B 17/02; A63B 17/04; A63B 21/00047; A63B 21/00069; A63B 21/068; A63B 21/1681; A63B 21/4027; A63B 21/4029; A63B 21/4033; A63B 21/4034; A63B 21/4035; A63B 21/4045; A63B 22/0015; A63B 22/0046; A63B 23/0205; A63B 23/1227; A63B 23/1236; A63B 2210/50; A63B 2210/58; A63B 2225/093; A63B 2225/10; A63B 21/4031

See application file for complete search history.

(56) References Cited

U.S. PATENT DOCUMENTS 1,495,536 A * 5/1924 Smith ..... A63B 1/00 482/38
3,207,511 A * 9/1965 Hoffman ..... A63B 17/00 482/104
3,472,509 A * 10/1969 Flynn ..... A63B 17/00 182/129
3,501,140 A * 3/1970 Eichorn ..... A63B 1/00 482/130
3,735,979 A * 5/1973 Levenberg ..... A63B 9/00 482/143

(Continued)

*Primary Examiner* — Joshua Lee
(74) *Attorney, Agent, or Firm* — The Rapacke Law Group, P.A.

(57) ABSTRACT

Embodiments described herein include an adjustable progressive exercise platform apparatus for use in a variety of settings. According to one aspect, the adjustable progressive exercise platform further includes a base portion and a platform. The base portion further includes a first and section portion that are releasably affixed about an axis and further contain an at least one set of horizontal apertures. The platform is substantially elongated and dimensioned to be releasably secured with the at least one set of horizontal apertures and provide a plurality of gradual resistance to at least one muscle group.

15 Claims, 3 Drawing Sheets

(56) References Cited

U.S. PATENT DOCUMENTS 3,892,404 A * 7/1975 Martucci ..... A63B 21/068 482/145
4,004,801 A * 1/1977 Campanaro ..... A61H 1/0218 403/14
4,286,782 A * 9/1981 Fuhrhop ..... A63B 21/078 482/103
4,826,158 A * 5/1989 Fields, Jr. ..... A63B 23/0488 482/142
4,911,438 A * 3/1990 Van Straaten ..... A63B 21/068 482/130
5,938,571 A 8/1999 Stevens
6,217,483 B1 * 4/2001 Kallassy ..... A63B 21/068 482/38
6,692,412 B2 * 2/2004 Chen ..... A63B 21/068 482/132
6,695,754 B1 * 2/2004 Gazzolo ..... A63B 23/12 482/141
6,699,162 B2 * 3/2004 Chen ..... A63B 21/4015 482/140
6,767,314 B2 * 7/2004 Thompson ..... A63B 21/068 482/135
7,309,303 B1 * 12/2007 Proctor ..... A63B 3/00 482/121
7,503,880 B2 * 3/2009 Campanaro ..... A63B 21/062 482/132
7,591,763 B1 * 9/2009 Fucci ..... A63B 21/0552 482/121
7,896,786 B1 * 3/2011 Osbourne ..... A63B 21/0552 482/122
7,918,770 B1 * 4/2011 Hoole ..... A63B 23/03525 482/105
8,033,971 B2 * 10/2011 Campanaro ..... A63B 21/068 482/142
8,834,332 B2 9/2014 Campanaro et al.
2001/0004624 A1 * 6/2001 Cournoyer ..... A63B 21/068 482/141
2004/0224827 A1 * 11/2004 Ashley ..... A63B 21/02 482/122
2005/0003938 A1 * 1/2005 Henderson ..... A63B 21/068 482/143
2005/0250628 A1 * 11/2005 Goldstein ..... A63B 23/1209 482/141
2008/0051274 A1 * 2/2008 Greene ..... A63B 22/0002 482/142
2008/0171643 A1 7/2008 Baudhuin
2009/0072111 A1 * 3/2009 Piane, Jr. ..... A63B 1/00 248/309.1
2010/0105532 A1 * 4/2010 Israeli ..... A63B 1/00 482/131
2010/0227743 A1 * 9/2010 Jutte ..... A63B 21/16 482/87
2012/0053028 A1 * 3/2012 Campanaro ..... A63B 21/00072 482/131
2013/0035217 A1 * 2/2013 Beck ..... A63B 23/04 482/79
2013/0225372 A1 * 8/2013 Rochford ..... A63B 1/00 482/38
2013/0237394 A1 * 9/2013 Fowler ..... A63B 17/00 482/142
2013/0324383 A1 * 12/2013 Rogers ..... A63B 26/00 482/142
2014/0087928 A1 * 3/2014 Luedeka ..... A63B 21/4023 482/130
2014/0113773 A1 * 4/2014 Marghella ..... A63B 1/00 482/38
2014/0135182 A1 * 5/2014 Inglut ..... A63B 21/068 482/96
2014/0135183 A1 * 5/2014 Inglut ..... A63B 21/068 482/96
2014/0274571 A1 * 9/2014 Aral Diaz ..... A63B 17/00 482/37
2014/0315700 A1 * 10/2014 Stallman ..... A63B 21/00047 482/141
2015/0182772 A1 * 7/2015 Matthew ..... A63B 21/00047 482/129
2015/0196799 A1 * 7/2015 Chua ..... A63B 23/1236 482/141
2015/0246263 A1 * 9/2015 Campanaro ..... A63B 23/03566 482/52
2015/0297948 A1 * 10/2015 Meister ..... A63B 23/03566 482/122

* cited by examiner

ADJUSTABLE PROGRESSIVE EXERCISE PLATFORM APPARATUS FOR USE IN A VARIETY OF SETTINGS

CROSS-REFERENCE TO RELATED APPLICATION

This application claims the benefit of provisional patent application No. 62/022,283 filed on Jul. 9, 2014 by the present inventor.

FIELD

The present embodiments relate to an adjustable progressive exercise platform apparatus, and in particular, to an adjustable progressive exercise platform that provides for gradual progression resistance training and may be used in a variety of settings.

BACKGROUND

Currently there are a variety of devices and systems designed to increase strength and performance utilizing basic crunch, sit up, and push up routines. Although these devices provide a benefit to the abdominis and pectoralis muscle groups, their limited functionality inhibits their ability to provide a "full body workout." For example, many push-up devices are designed to strengthen your pectoralis major muscle groups and improve push-up performance, but provide only limited benefits to the major core muscle groups of the: Rectus Abdominis, Erector Spinae, Multifidus, External Oblique's, Internal Oblique's, Transverse Abdominis, Hip Flexors, Hip Adductors, and Gluteus muscles.

Progressive strength training targets a plurality of muscle groups along the trunk and torso to enable even development of muscles and power to both the core and extremities through a customized gradual progression resistance routine. Furthermore, the foundation of progressive training is to develop a strong core, balanced back and chest muscles, prevent injury, and to ensure proper spinal stability. These progressive strength exercises may be completed in a variety of settings (i.e., home, office, or a hotel) utilizing the user's own body weight in a plurality of configurations to adjust resistance and isolate different muscle groups.

Therefore, there is a need for a portable exercise apparatus that may be adjustable to provide the proper resistance based on each user's individual physical characteristics.

SUMMARY OF THE INVENTION

Embodiments described herein include an adjustable progressive exercise platform apparatus. According to the current aspect, the apparatus is further comprised of a base platform that includes first and second portions releasably affixed about an axis. The adjustable exercise platform is further configured to fit and lock within the base portion using a locking pin and may be adjustable to provide a user with a plurality of customizable progressive workouts. Further, the current embodiment allows a user to fold the first and second portions about a hinge located at the axis, apply a securing strap, and carry the apparatus with a single hand. At least one set of stabilization wings provide additional base support and ensure the weight applied to the apparatus is evenly distributed.

In another aspect, a further embodiment includes at least one set of dip bars which may be horizontally inserted and releasably housed within at least the one set of horizontal apertures of the first and second portions and configured to target the tricep brachii muscles.

In another aspect, an even further embodiment includes a platform that is substantially circular to provide gradual resistance in the decline and lateral positions.

In another aspect, a further embodiment includes at least one spring-loaded adjustable base leg configured to shift the center of gravity and allow a user to develop a plurality of stabilization muscles.

In another aspect, a further embodiment includes at least one set of reverse row bars that may be horizontally inserted within the at least one set of horizontally apertures and configured to enable a user to perform a plurality of reverse-row exercises.

Other aspects, advantages, and novel features of the present invention will become apparent from the following detailed description in conjunction with the drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

As used herein, relational terms, such as "first" and "second," "top" and "bottom," and the like, may be used solely to distinguish one entity or element from another entity or element without necessarily requiring or implying any physical or logical relationship or order between such entities or elements.

The specific details of the single embodiment or variety of embodiments described herein are set forth in this application. Any modification or alternative embodiments described in this application that do no not depart from those skilled in the ordinary art do not depart from the scope or spirit of the embodiments of this application.

The present embodiment relates to an adjustable progressive exercise platform apparatus for use in a variety of settings. The current embodiment enables a user to erect the apparatus in a plurality of settings, customize the resistance by adjusting and securing the height of the platform to meet the physical characteristic of the user while performing plyometric, planks, push-ups, and gradual resistance exercises.

Figure 1:
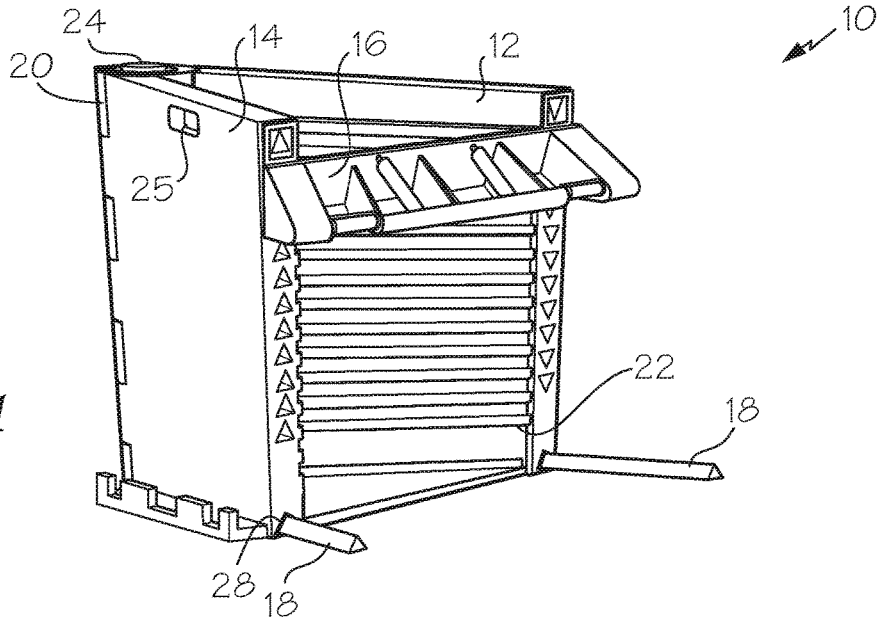
FIG. 1 is a perspective view of a multi-level adjustable progressive exercise platform apparatus.

Referring now to the drawings wherein like reference numerals designate identical or corresponding parts throughout the views, there is shown in FIG. 1 an adjustable progressive exercise platform apparatus 10. The apparatus 10 further includes a first section 12, a second section 14, a platform 16, and a set of stabilization wings 18. The first section 12 and second section 14 are releasably affixed about an axis 20. Further, the first section 12 and second section 14 are oppositely facing an evenly spaced to enable a user to releasably secure the platform 16 with at least one set of horizontal apertures 22. Specifically, the platform 16 is substantially elongated and dimensioned to releasably engage the at least one set of horizontal apertures 22, thus making the platform 16 wedge-shaped, and to secure the platform 16 using a locking pin 24 that passes through locking aperture 17 at an end 16' of the platform 16 opposite its bars 30, 34, 36 (see FIGS. 4-5). Furthermore, the apparatus 10 may be carried by a user with a single hand using at least one handle 25.

Figure 2:
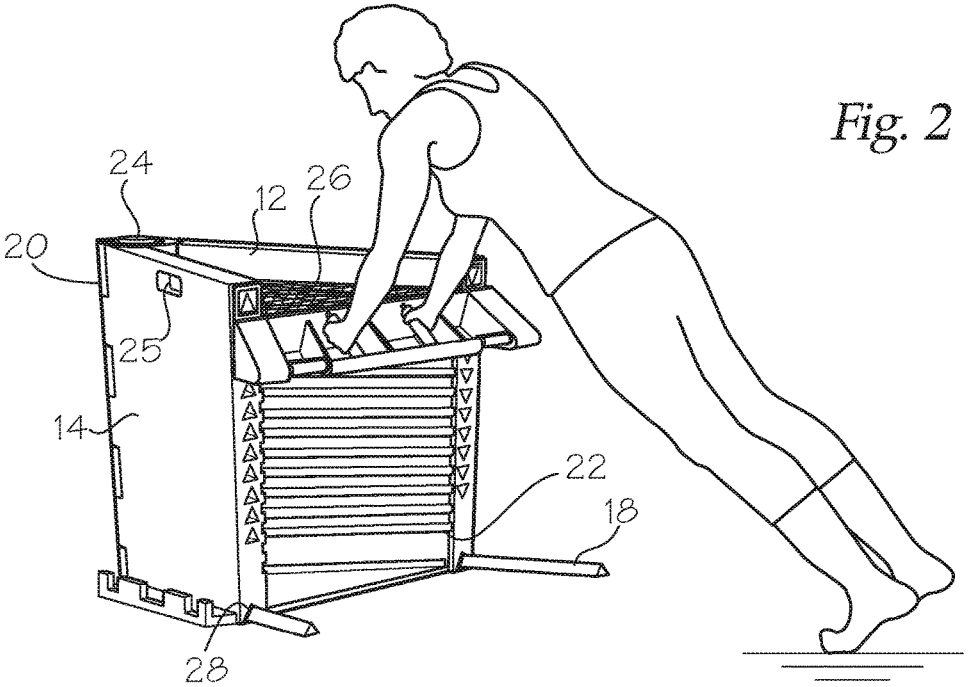
FIG. 2 is a view of the apparatus while being operated as shown in FIG. 1.

FIG. 2 shows the apparatus 10 while being operated by a user to strengthen at least one muscles group along the arms, legs, or torso muscles groups. A non-skid tread pad 26 is inserted onto the platform 16 to provide additional friction to the platform 16 and ensure that the user does not slip from excess moisture or perspiration. The at least one set of stabilization wings 18 are extended from a housing 28 and configured to increase base support and evenly distribute the applied weight while operating.

Figure 3:
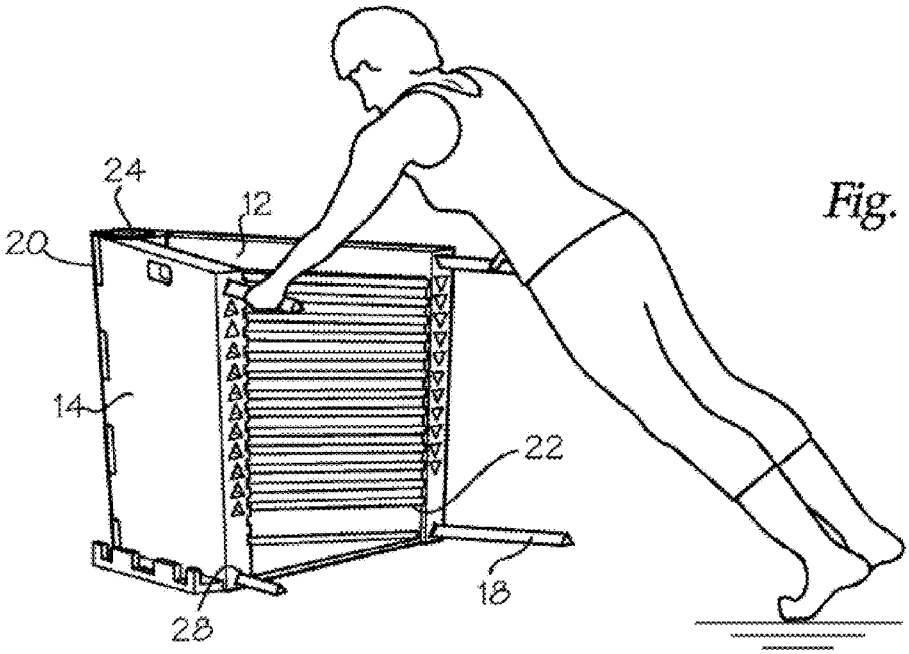
FIG. 3 is an alternate embodiment of the apparatus with at least one set of dip bars.

FIG. 3 is an alternate embodiment of apparatus 10 further including at least one set of dip bars 30. The at least one set of dip bars 30 are substantially elongated and dimensioned to be releasably secured with at least one set of horizontal apertures 22. The at least one set of dip bars 30 are comprised of an injection molded thermoplastic and configured to enable a user to do a plurality of tricep brachii exercises.

Figure 4:
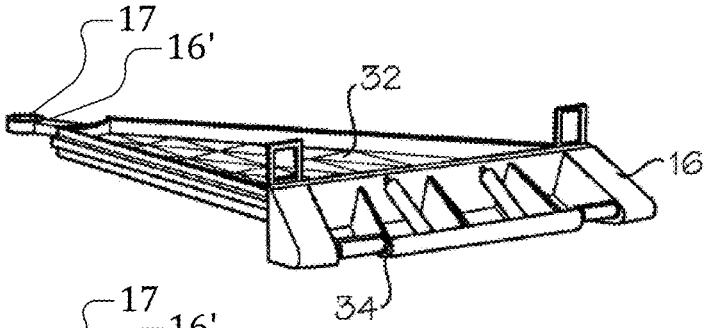
FIG. 4 is an alternate embodiment of the apparatus platform with a contoured surface.

FIG. 4 is an alternate embodiment of apparatus 10 wherein the platform 16 further includes at least one contoured surface pattern 32 and at least one set of grip bars 34 configured to isolate the abdominis, tricep brachii, and pectoralis major muscle groups.

Figure 5:
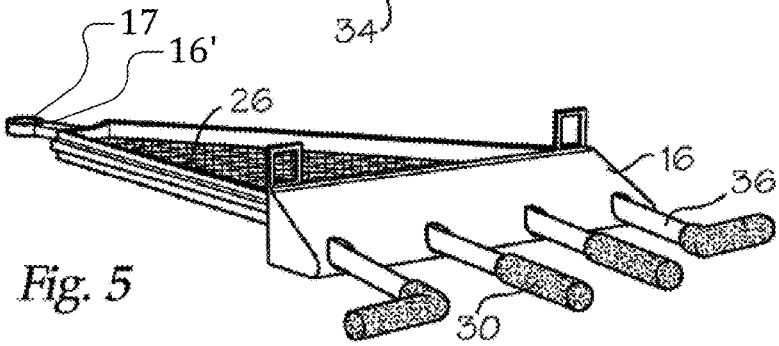
FIG. 5 is a further alternate embodiment of the apparatus with grip bars.

FIG. 5 is an alternate embodiment of apparatus 10 wherein the platform 16 further includes at least one set of narrow grip bars 36 configured to isolate the pectoralis minor and tricep brachii.

Figure 6:
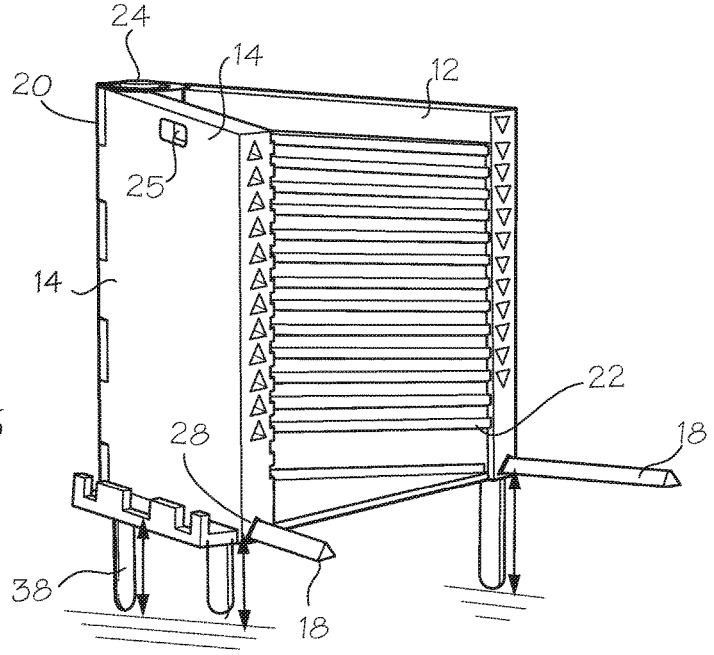
FIG. 6 is a further alternate embodiment with at least one set of adjustable legs.

FIG. 6 is a further embodiment of apparatus 10 wherein the first section 12 and second section 14 further include at least one adjustable leg 38. The at least one adjustable leg 38 may be releasably retracted from the first section 12 and second section 14 to provide an asymmetrical configuration and further isolated the abdominis, tricep brachii, and pectoralis major muscle groups.

Figure 7:
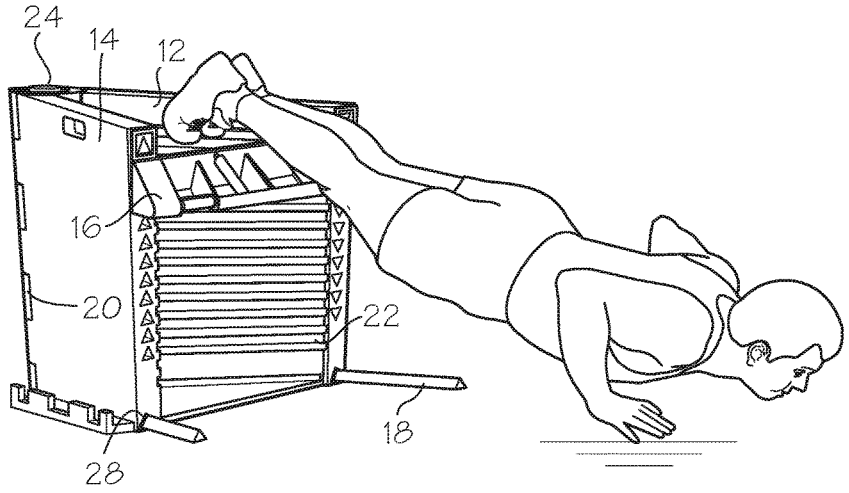
FIG. 7 is a further alternate embodiment in the decline position.

FIG. 7 shows the apparatus 10 while being operated in which the user, having placed their feet on the platform 16, is performing at least one gradual progression decline exercise.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the following claims.

What is claimed is:

1. A multi-level adjustable progressive exercise platform apparatus, comprising:

a collapsible base portion having a plurality of sections wherein a portion of a first section and a second section are connected using a locking pin vertically oriented at a leading side of the first section and the second section and which further includes a plurality of horizontal apertures configured to releasably mount a platform;

a platform configured to be releasably secured within the plurality of horizontal apertures of the collapsible base portion to enable a user to adjust the height of the platform before and/or after an exercise and to secure the platform such that it is fixed in place during the exercise; and a set of stability wings housed within the collapsible base portion and configured to releasably extend from the collapsible base portion along a ground surface to provide increased base support.

2. The apparatus of claim 1, wherein the collapsible base portion further includes at least one hinge configured to enable a user to fold the collapsible base portion.

3. The apparatus of claim 1, wherein the collapsible base portion further includes at least one set of adjustable legs configured to allow a user increased gradual resistance.

4. The apparatus of claim 1, wherein at least one set of dip bars may be horizontally inserted within at least one set of apertures.

5. The apparatus of claim 1, wherein at least one set of reverse row bars may be horizontally inserted within at least one set of horizontal apertures.

6. The apparatus of claim 1, wherein the platform further includes at least one set of grip bars configured to enable a user to perform a plurality of incline and lateral exercises.

7. The apparatus of claim 1, wherein the platform is wedge-shaped.

8. A multi-level adjustable progressive exercise platform apparatus, comprising:

a base portion, the base portion having a plurality of sections wherein a portion of a first section and a second section are oppositely facing each other and are connected using a locking pin located and vertically oriented at a leading side of the first section and the second section; the two oppositely facing side sections are evenly spaced apart and further include at least one set of horizontal apertures configured to releasably secure a platform and enable a user to perform at least one gradually progressive exercise;

at least one wedge-shaped platform configured to be releasably secured within at least one set of horizontal apertures of the base portion to enable a user to adjust the height of the platform before and/or after an exercise and to secure the platform such that it is fixed in place during the exercise; and at least one set of stability wings, each stability wing releasably housed within the base portion and releasably extended from the base portion along a ground surface to provide increased base support.

9. The apparatus of claim 8, wherein the at least one platform comprises at least one set of dip bars.

10. The apparatus of claim 8, wherein the at least one platform comprises at least one set of reverse row bars.

11. The apparatus of claim 8, wherein the at least one platform further includes at least one set of grip bars configured to enable a user to perform at least one gradual progression exercise.

12. A multi-level adjustable progressive exercise platform apparatus, comprising:

a base portion, the base portion further including first and second portions releasably affixed about a vertical axis and configured with a plurality of horizontal notches on a first side of the first and second portions, respectively, to enable an adjustable platform to be releasably secured within the plurality of horizontal notches;

an adjustable platform dimensioned to be releasably secured with the plurality of horizontal notches and configured to allow a user to perform at least one gradual progression exercise, and further configured to enable a user to adjust the height of the platform before and/or after an exercise and to secure the platform such that it is fixed in place during the exercise, wherein the adjustable platform comprises a locking aperture configured to align with the vertical axis;

a locking pin releasably housed within the base portion along the axis and passing through the locking aperture to secure the adjustable platform; and at least one set of stabilization wings, the set of stabilization wings are releasably housed within the base portion and configured to be extended outward from the base portion to provide support while performing at least one gradual progression exercise.

13. The apparatus of claim 12, wherein the adjustable platform is wedge-shaped.

14. The apparatus of claim 12, wherein the adjustable platform comprises at least one set of dip bars.

15. The apparatus of claim 12, wherein the adjustable platform comprises at least one set of reverse row bars.

* * * * *